US007905185B2

(12) United States Patent
Peery et al.

(10) Patent No.: US 7,905,185 B2
(45) Date of Patent: Mar. 15, 2011

(54) TABLE TOP WITH INTEGRAL ALIGNMENT MEMBERS

(75) Inventors: Wendell Peery, Kaysville, UT (US); Donald Waite, N. Ogden, UT (US); Paul Branch, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 192 days.

(21) Appl. No.: 11/703,880

(22) Filed: Feb. 8, 2007

(65) Prior Publication Data

US 2007/0199483 A1 Aug. 30, 2007

Related U.S. Application Data

(60) Provisional application No. 60/772,119, filed on Feb. 9, 2006.

(51) Int. Cl.
*A47B 3/00* (2006.01)

(52) U.S. Cl. ..... 108/132; 108/157.1

(58) Field of Classification Search ..... 108/132, 108/129, 166, 167, 168, 169, 170, 125, 131, 108/161, 157.1; 248/188.6
See application file for complete search history.

(56) References Cited

U.S. PATENT DOCUMENTS

| | | | |
|---|---|---|---|
| 1,165,991 | A | 12/1915 | Maggs |
| 1,683,579 | A | 9/1928 | Page et al. |
| 1,698,420 | A | 1/1929 | Willett |
| 1,875,772 | A | 9/1932 | Strathaus |
| 1,882,939 | A | 10/1932 | Root |
| 1,918,003 | A | 7/1933 | Brooks et al. |
| 2,567,417 | A | 9/1951 | Adler |
| 2,689,158 | A | 9/1954 | Mahr |
| 3,304,891 | A | 2/1967 | Rachman |
| 3,357,729 | A | 12/1967 | Krueger |
| 3,368,504 | A | 2/1968 | Cohen |
| 3,635,432 | A | 1/1972 | Hollander |
| 3,718,306 | A | 2/1973 | Murray |
| 4,313,385 | A | 2/1982 | Fitzgerald |
| 4,509,461 | A | 4/1985 | Peck |
| 4,609,192 | A | 9/1986 | Bratcher |
| 4,759,296 | A | 7/1988 | Simpson |
| 5,014,628 | A | 5/1991 | Roberts |
| 5,271,338 | A | 12/1993 | Bonham |
| 5,279,233 | A | 1/1994 | Cox |
| 5,357,872 | A | 10/1994 | Wilmore |

(Continued)

FOREIGN PATENT DOCUMENTS

WO WO 95/10204 4/1995

OTHER PUBLICATIONS

U.S. Appl. No. 11/112,236, filed on Apr. 22, 2005, Neunzert.

(Continued)

*Primary Examiner* — José V Chen
(74) *Attorney, Agent, or Firm* — Maschoff, Gilmore & Israelsen

(57) ABSTRACT

A table may include a table top and a frame. The frame may be connected to the table top using one or more fasteners. When a force is applied to the table, such as a force that draws the frame away from the table top, the fasteners may contact and/or engage one or more stops, which may help resist the frame's movement away from the table top and may help prevent damage to the table top.

20 Claims, 6 Drawing Sheets

U.S. PATENT DOCUMENTS

| | | | | |
|---|---|---|---|---|
| 5,418,987 | A | 5/1995 | Yoshino | |
| 5,483,901 | A | 1/1996 | Tisbo | |
| 5,528,997 | A | 6/1996 | Miller | |
| 5,623,882 | A | 4/1997 | Price | |
| 5,636,578 | A | 6/1997 | Rizzi | |
| 5,678,491 | A | 10/1997 | Price et al. | |
| 5,694,865 | A | 12/1997 | Raab | |
| 5,732,637 | A | 3/1998 | Raab | |
| 5,868,081 | A | 2/1999 | Raab | |
| 5,921,623 | A | 7/1999 | Nye et al. | |
| 5,947,037 | A | 9/1999 | Hornberger et al. | |
| 5,983,807 | A | 11/1999 | Tarnay et al. | |
| 6,058,853 | A | 5/2000 | Pinch | |
| 6,058,854 | A | 5/2000 | Tarnay et al. | |
| 6,109,687 | A | 8/2000 | Nye et al. | |
| 6,112,674 | A | 9/2000 | Stanford | |
| 6,371,034 | B1 | 4/2002 | Simpson et al. | |
| 6,374,756 | B1 | 4/2002 | Fieldwick et al. | |
| 6,422,157 | B2 | 7/2002 | Rumph | |
| 6,443,521 | B1 | 9/2002 | Nye et al. | |
| 6,508,184 | B1 | 1/2003 | Winter et al. | |
| 6,530,331 | B2 | 3/2003 | Stanford | |
| 6,550,404 | B2 | 4/2003 | Stanford | |
| 6,615,743 | B2 * | 9/2003 | Nien | 108/132 |
| 6,655,301 | B2 | 12/2003 | Stanford | |
| 6,666,152 | B2 | 12/2003 | Tsai | |
| D489,557 | S | 5/2004 | Strong et al. | |
| 6,732,663 | B2 | 5/2004 | Tsai | |
| 6,823,806 | B1 * | 11/2004 | Buono | 108/132 |
| 6,848,370 | B1 | 2/2005 | Stanford | |
| 6,877,441 | B2 * | 4/2005 | Zheng | 108/130 |
| 6,915,748 | B2 | 7/2005 | Stanford | |
| 6,920,833 | B2 | 7/2005 | Lou-Hao | |
| 6,968,789 | B2 * | 11/2005 | Baik et al. | 108/132 |
| 7,069,865 | B2 | 7/2006 | Strong | |
| 7,100,518 | B2 | 9/2006 | Strong | |
| 7,128,002 | B2 * | 10/2006 | Stanford | 108/132 |
| 7,150,237 | B2 * | 12/2006 | Lin et al. | 108/132 |
| 7,171,910 | B2 | 2/2007 | Neunzert | |
| 7,278,361 | B2 * | 10/2007 | Zhurong et al. | 108/168 |
| 7,428,872 | B2 * | 9/2008 | Strong et al. | 108/132 |
| 7,434,522 | B2 * | 10/2008 | Stanford | 108/132 |
| 7,469,646 | B2 * | 12/2008 | Baik et al. | 108/132 |
| 7,475,641 | B2 * | 1/2009 | Jin | 108/132 |
| 7,475,642 | B2 * | 1/2009 | Shenghao et al. | 108/132 |
| 7,475,644 | B2 * | 1/2009 | Strong et al. | 108/132 |
| 2003/0005864 | A1 | 1/2003 | Wen | |
| 2003/0106474 | A1 | 6/2003 | Buono | |
| 2003/0177962 | A1 | 9/2003 | Stanford | |
| 2003/0233967 | A1 | 12/2003 | Lin | |
| 2004/0031422 | A1 | 2/2004 | Wong | |
| 2004/0255829 | A1 * | 12/2004 | Cizmar et al. | 108/132 |
| 2005/0028711 | A1 | 2/2005 | Neunzert et al. | |
| 2005/0103239 | A1 * | 5/2005 | Neunzert et al. | 108/132 |
| 2005/0155532 | A1 * | 7/2005 | Lin et al. | 108/132 |
| 2005/0241550 | A1 | 11/2005 | Neunzert et al. | |
| 2005/0241551 | A1 | 11/2005 | Neunzert et al. | |

OTHER PUBLICATIONS

Office Action dated Sep. 18, 2007, from U.S. Appl. No. 11/112,236.
Office Action dated Dec. 28, 2006, from U.S. Appl. No. 11/112,236.

* cited by examiner

TABLE TOP WITH INTEGRAL ALIGNMENT MEMBERS

CROSS-REFERENCE TO RELATED APPLICATIONS

This application claims priority to, and the benefit of, U.S. provisional patent application Ser. No. 60/772,119, filed Feb. 9, 2006 and entitled TABLE, the disclosure of which is incorporated by reference in its entirety.

BACKGROUND OF THE INVENTION

1. Field of the Invention

The present invention generally relates to tables.

2. Description of Related Art

Conventional tables may include a table top and one or more legs or leg assemblies. Conventional tables may also include frame connected to the table top and the table top may be constructed from materials such as wood or plastic. The frame may include a pair of side rails that are connected to the table top using one or more fasteners. When an excessive force or load is applied to the table, the fasteners may allow the frame to detach or separate from the table top. In addition, if the table top is constructed from plastic, the fasteners can damage and even tear through the table top if the load or force exceeds a certain amount.

BRIEF SUMMARY OF EMBODIMENTS OF THE INVENTION

A need therefore exists for a table that eliminates or diminishes the disadvantages and problems described above.

One aspect is a table that may include a table top, a frame and one or more stops. The frame may be connected to the table top using one or more fasteners, and the stops may be disposed proximate the fasteners. Consequently, when a force is applied to the table, such as a force that draws the frame away from the table top, the fasteners may contact and/or engage the stops, which may help resist the frame's movement away from the table top. Resisting this movement may advantageously help the table top and the frame to remain in a generally fixed relative position.

Another aspect is a table that may include a table top, which may include one or more stops, a frame and fasteners connecting the frame to the table top. Advantageously, the fasteners may abut the stops of the table top. In addition, the fasteners may extend along at least half of the depth of the stops and may extend past the stops, if desired. Significantly, when forces are applied to the table that may draw the frame away from the table top, the fasteners may contact and/or engage the stops, which may allow a larger force to be applied to the table. For example, when the fasteners contact the stops, the forces may be spread out along a larger part of the stops. Advantageously, this may help the stops resist the fasteners' movement, which may help prevent the fasteners from damaging portions of the table top.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a table. The principles of the present invention, however, are not limited to tables. It will be understood that, in light of the present disclosure, the table disclosed herein can be successfully used in connection with other types of furniture or structures.

Additionally, to assist in the description of the table, words such as top, bottom, front, rear, right and left may be used to describe the accompanying figures, which are not necessarily drawn to scale. It will be appreciated, however, that the table can be located in a variety of desired positions—including various angles, sideways and even upside down.

Figure 1:
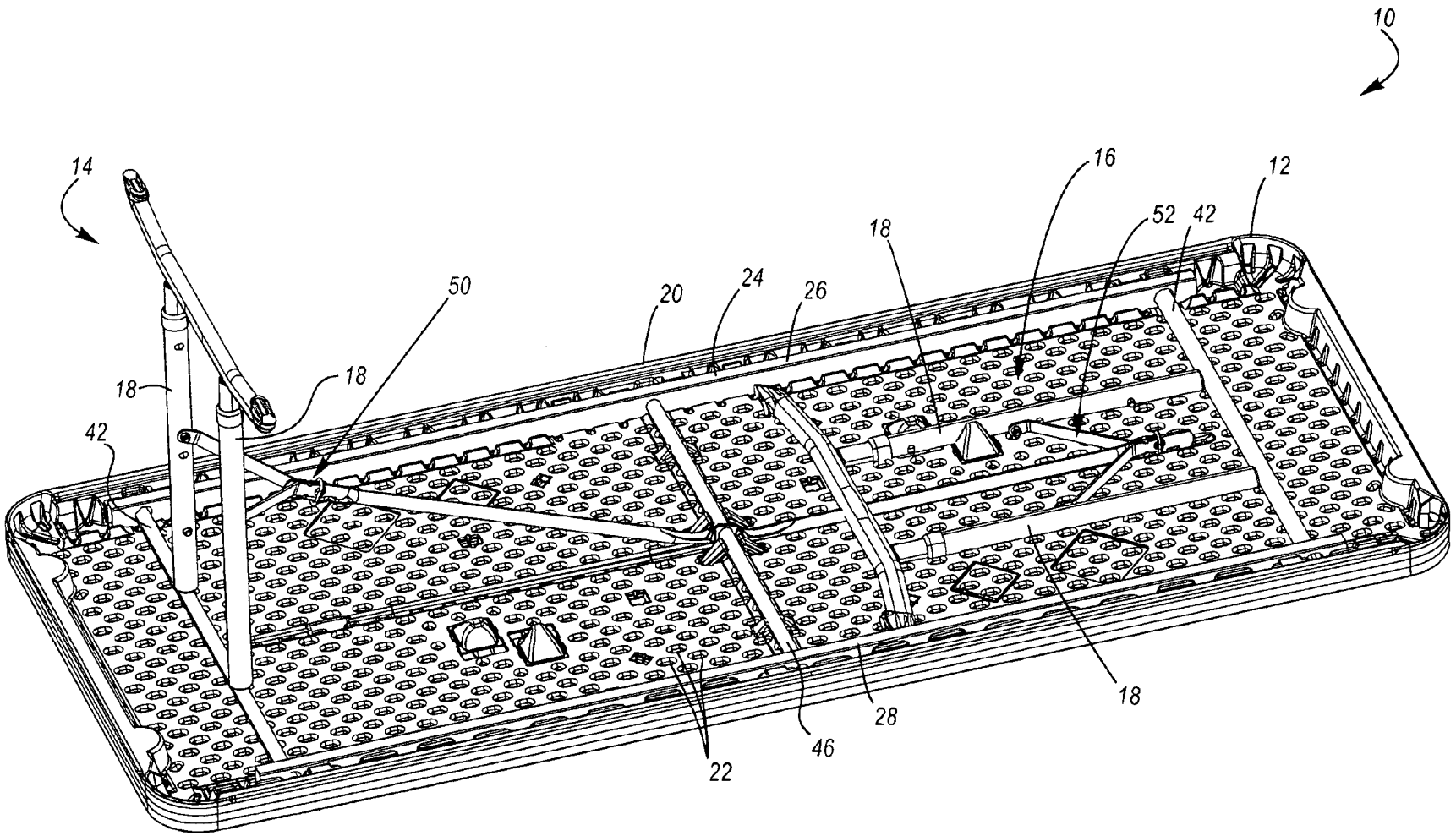
FIG. 1 is a perspective view of an exemplary table.

As shown in FIG. 1, an exemplary embodiment of a table 10 includes a table top 12 with a first leg assembly 14 and a second leg assembly 16 that may be used to support the table top above a surface such as the floor. The first and second leg assemblies 14, 16 may include one or more legs 18. For example, as shown in the accompanying figures, the first and second leg assembles 14, 16 could include two legs 18 that are interconnected. The leg assemblies 14, 16 could also include only a single leg 18, if desired. In addition, the leg assemblies 14, 16 could include any suitable number and configuration of legs 18, and the leg assemblies may include other suitable parts and components depending, for example, upon the design of the leg assemblies. One of ordinary skill in the art will appreciate that the leg assemblies 14, 16 and legs 18 may have a variety of suitable shapes and sizes, and the leg assemblies and/or legs may have a fixed or adjustable length.

The leg assemblies 14, 16 are preferably movable between a collapsed position and an extended position relative to the table top 12. For example, as shown in FIG. 1, the first leg assembly 14 is in the extended position in which the leg assembly extends outwardly from the table top 12, and the second leg assembly 16 is in the collapsed position in which the leg assembly is generally adjacent and parallel to the lower portion of the table top. When the leg assemblies 14, 16 are in the collapsed position, all or a portion of the leg assemblies may contact or abut the lower portion of the table top 12, if desired. Advantageously, this may facilitate shipping and/or stacking of the tables 10. As discussed in greater detail below, the leg assemblies 14, 16 may be pivotally connected to the table top 12, but the leg assemblies may be connected to the table top in any suitable manner.

As shown in FIG. 1, the table top 12 may have a generally rectangular shape. For example, the table top 12 may have a length of about 72 inches (about 1.8 meters) and a width of about 30 inches (about 0.76 meters). Advantageously, this size of table top 12 may be used to form a utility-type table, which may allow the table 10 to be used for a wide variety of purposes and reasons. One of ordinary skill in the art will understand that the table top 12 could also be larger or smaller depending, for example, upon the intended use of the table 10. The table top 12 could also have other suitable configurations such as a generally circular configuration with a diameter of about 60 inches (about 1.54 meters) or a generally square configuration with about 37-inch (about 0.94 meters) sides. The table 10 may include a relatively small table top 12 that is sized and configured for use by an individual. On the other hand, if the table 10 is intended to be used by more than one person, then the table top 12 may have a larger size. Significantly, the table top 12 may be sized and configured for numerous suitable particular purposes and functions, such as a personal table, computer table, game table, bedside table, night stand, television table, utility table, card table, conference table and the like. While the table 10 may be sized and configured for a particular use or activity, the table could also have a general shape, design and/or configuration to allow it to be used in a variety of situations and circumstances.

The table top 12 is preferably constructed from a lightweight material and, more preferably, the table top is constructed from plastic, such as high density polyethylene. The plastic table top 12 is desirably formed by a blow-molding process because, for example, the blow-molding process may allow a strong, lightweight, rigid and sturdy table top to be quickly and easily manufactured. Advantageously, a blow-molded plastic table top 12 may have a lighter weight than a conventional table top, which may allow the table 10 to be more easily moved, transported and stored. The blow-molded plastic table top 12 may also be constructed from less plastic than a conventional plastic table top, and that may reduce manufacturing expenses and consumer costs. In addition, the blow-molded plastic table top 12 may be constructed with thinner outer walls and that may allow the table top to cool more quickly during the manufacturing process. This may decrease the time required to create the table top 12 and may increase the efficiency in which the table 10 is manufactured.

The blow-molded plastic table top 12 may be lightweight because it may include a hollow interior portion that is formed during the blow-molding process. Advantageously, the lightweight table top 12 may allow a lighter weight table 10 to be constructed. The lighter weight table 10 may reduce shipping costs and may allow the consumer to more easily move the table. One of ordinary skill in the art will appreciate that the hollow interior portion formed during the manufacturing process may be subsequently filled with material, such as foam, and that the table top 12 does not have to be formed with a hollow interior portion.

The table top 12 is preferably constructed from blow-molded plastic because flow-molded plastic table tops may be relatively durable, weather resistant, temperature insensitive, corrosion resistant and rust resistant. In addition, blow-molded plastic generally does not deteriorate over time and can be used in a wide variety of environments. One skilled in the art, however, will appreciate that the table top 12 does not have to be constructed from blow-molded plastic and other suitable materials and/or processes can be used to construct the table top depending, for example, upon the intended use of the table 10. Thus, the table top 12 could be constructed from other materials with suitable characteristics, such as, other plastics, composites, synthetics, wood, plywood, particle board, metal, metal alloys, fiberglass, ceramics and the like. Additionally, the table top 12 could be constructed using other suitable processes such as injection molding, extrusion molding, compression molding, rotary molding and the like.

The table top 12 may include one or more features such as a generally downwardly extending lip 20. Advantageously, the lip 20 may be integrally formed in the table top as part of a unitary, one-piece structure. The lip 20 may be disposed about the outer portion of the table top 12 or the lip may be disposed inwardly from the outer edge of the table top. The table top 12 may also include one or more recesses that are sized and configured to receive at least a portion of the leg assemblies 14, 16 when the leg assemblies are in the collapsed position. For example, as shown in the accompanying figures, a recess may be at least partially formed by the lower portion of the table top 12 and the lip 20. Advantageously, when the leg assemblies 14, 16 are in the collapsed position, the leg assemblies may be partially or completely disposed within the recess.

As discussed above, when the leg assemblies 14, 16 are in the collapsed position, the leg assemblies are preferably positioned generally adjacent and parallel to a lower portion of the table top 12. In addition, all or a portion of the leg assemblies 14, 16 may contact the lower portion of the table top 12 when the leg assemblies are in the collapsed position. Advantageously, when the leg assemblies 14, 16 are in the collapsed position, the leg assemblies may be sized, configured and positioned so that the leg assemblies do not extend beyond a plane that is generally aligned with a lower portion of the lip 20. The leg assemblies 14, 16 may also be sized, configured and positioned so that the leg assembles are at least substantially disposed within an envelope generally defined by the lower portion of the table top 12, the lip 20 and a plane generally aligned with a lower portion of the lip. Advantageously, these configurations may facilitate stacking of the tables 10, which may allow the tables to be more easily shipped and stored.

In greater detail, as shown in the accompanying figures, the lip 20 is preferably disposed about the outer periphery of the table top 12 and it may be generally aligned with the outer edge of the table top. In particular, the lip 20 may include an outer portion that is generally aligned with the outer edge of the table top 12, but the lip could be spaced inwardly if desired. The lip 20 may also include a lower portion with a generally even and level surface. Preferably, the lower portion of the lip 20 is generally aligned in the same plane to facilitate stacking of the table 10. In addition, the lip 20 may include a hollow interior portion and the lip may be integrally formed with the table top 12, for example, during the blow-molding process. Advantageously, this may allow the hollow interior portion of the lip 20 to be formed with the hollow interior portion of the table top 12 during the blow-molding process. This may also allow the hollow interior portion of the lip 20 to be in communication with the hollow interior portion of the table top 12. It will be appreciated, however, that the lip 20 does not have to be integrally formed with the table top 12 and the lip could be formed from other suitable processes and materials. It will also be appreciated that the lip 20 could be a separate component that is attached to the table top 12 and the lip could be disposed about all or only a portion of the table top. Further, it will be appreciated that the lip 20 could have a variety of suitable arrangements and configurations, and the table 10 does not require a lip.

Figure 2:
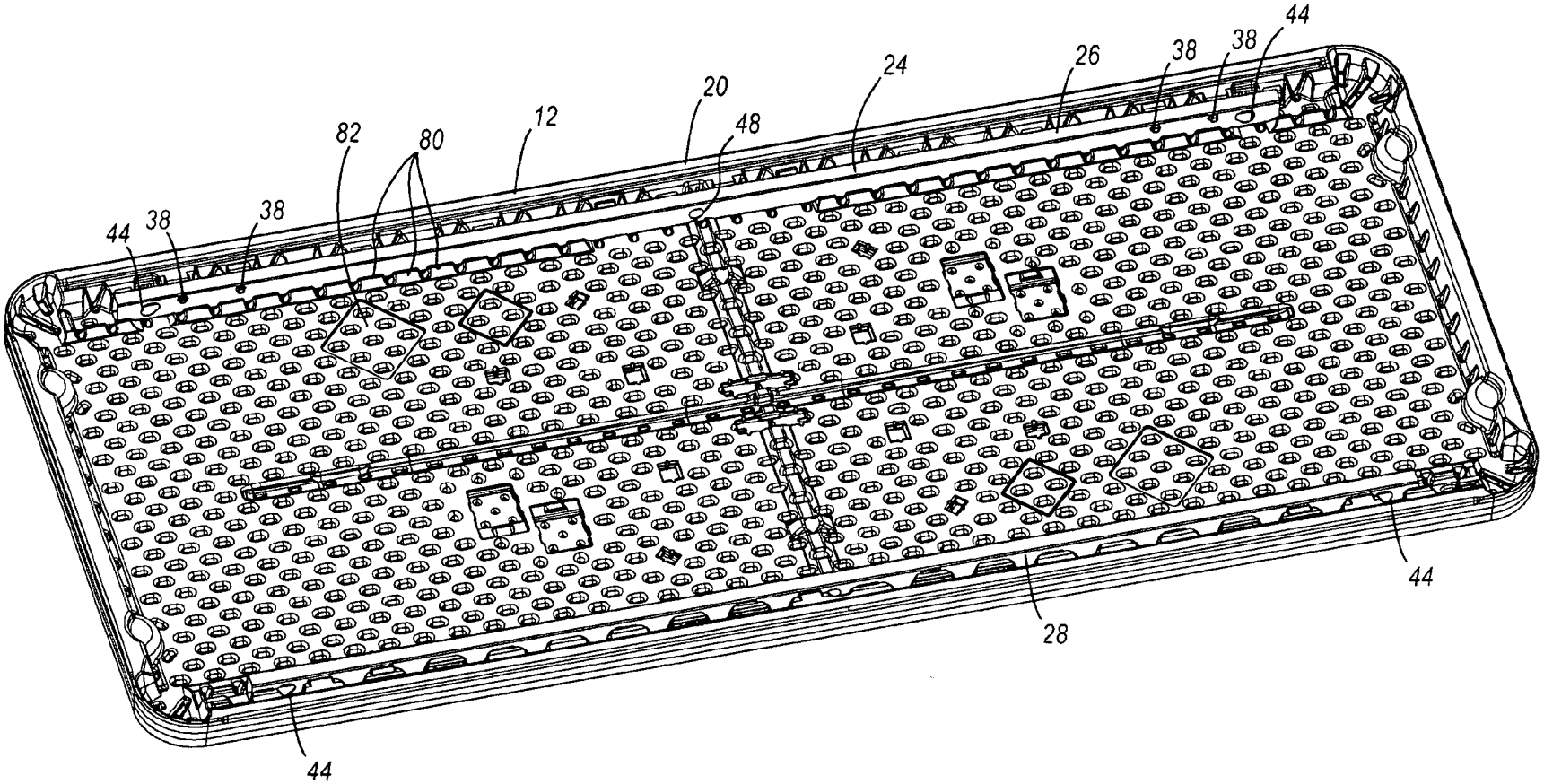
FIG. 2 is a perspective view of a portion of the table shown in FIG. 1, illustrating the table top and the frame.
Figure 3:
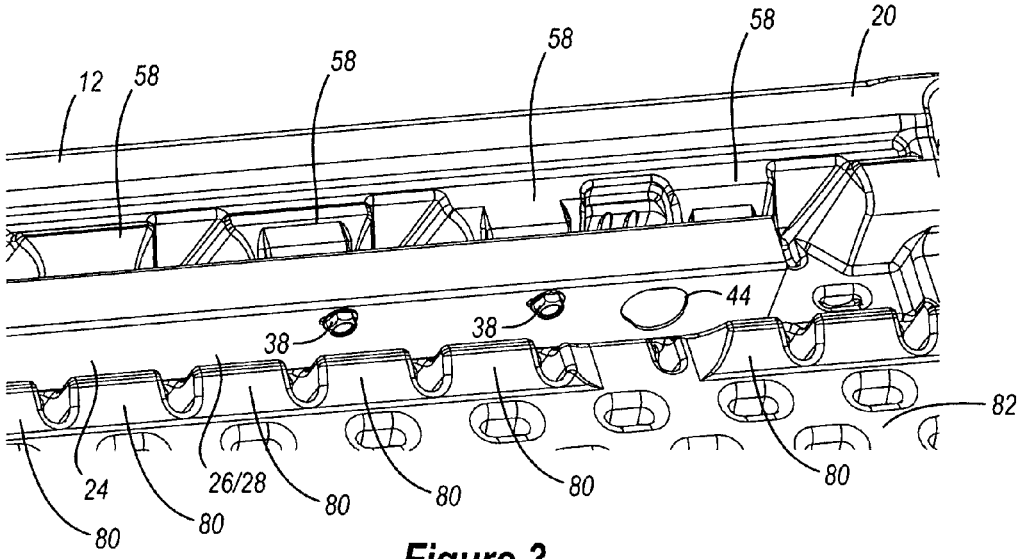
FIG. 3 is an enlarged view of a portion of the table top and frame shown in FIG. 2.
Figure 4:
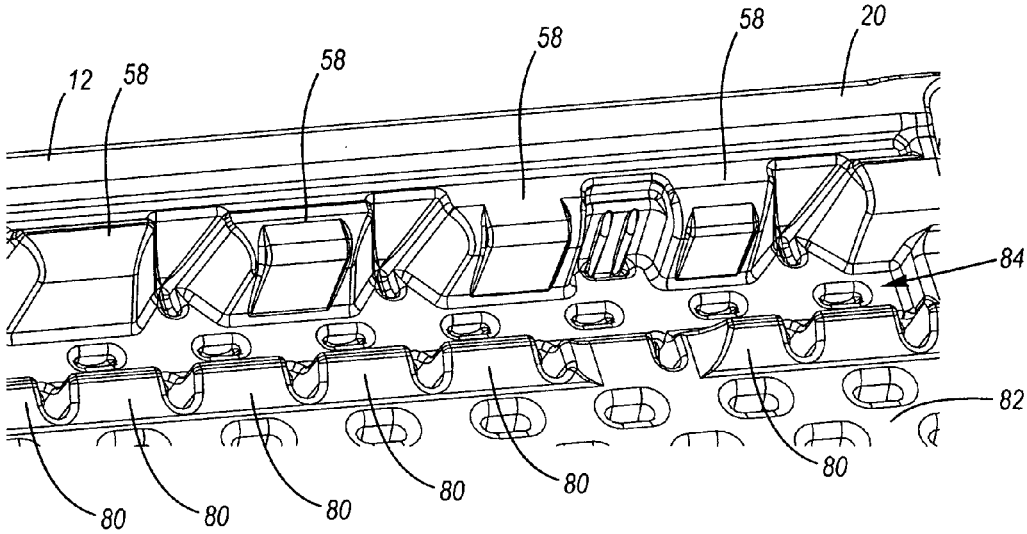
FIG. 4 is an enlarged view of a portion of the table top shown in FIG. 2.

The table top 12 may also include other features such as depressions 22, which are also known as tack-offs or kiss-offs. The depressions 22 may also be integrally formed as part of a unitary one-piece table top 12, such as during the blow-molding process. As shown in FIGS. 1-2, a plurality of depressions 22 may be disposed in the lower surface of the table top 12. The depressions 22 preferably cover at least a substantial portion of the lower surface of the table top 12 and the depressions preferably extend towards and/or contact an opposing surface, such as the upper surface of the table top. For example, depressions 22 may be formed in the lower portion of the table top 12 and the ends of the depressions may contact or abut the inner surface of the upper portion of table top 12 or the ends of the depressions may be spaced from the upper portion of the table top. The depressions 22 may also be formed in a predetermined pattern or array, and the depressions may be placed in a staggered, geometric, random or suitable arrangement. One of ordinary skill in the art will appreciate that the depressions 22 may be formed in any desired portions of the table top 12.

Advantageously, the depressions 22 may be sized and configured to increase the strength and/or structural integrity of the table top 12. For example, it was previously believed that stronger blow-molded plastic structures were created by increasing the thickness of the outer walls and/or adding reinforcement structures such as troughs or ribs. Increasing the number of depressions in a blow-molded plastic structure, however, created the surprising and unexpected result of a stronger structure. In addition, increasing the number of depressions created the surprising and unexpected result that the thickness of the outer walls may be reduced, which may allow a structure to be constructed with less plastic. Surprisingly, increasing the number of depressions increased the strength and structural integrity of the structure despite forming additional disruptions and discontinuities in the structure. These surprising and unexpected results allow the table top 12 to be constructed with less plastic even though the lower surface of the table top includes a greater number of disruptions and discontinuities created by the depressions 22. Additionally, the increased number of depressions 22 may increase the strength and/or structural integrity of the table top 12. Accordingly, less plastic may be used to make the table top 12 by increasing the number of depressions 22, which may create a lighter weight table 10.

Additionally, the depressions 22 may reduce the amount of time required to manufacture the table top 12. For example, when a blow-molded structure such as the table top 12 formed, a certain amount of time must elapse before the structure can be removed from the mold. Advantageously, blow-molded structures with thinner walls have a shorter cooling time than structures with thicker walls. Thus, the depressions 22 may allow table tops 12 with thinner plastic walls to be constructed and the cooling time required before the table tops can be removed from the mold may be decreased. Significantly, a reduced cycle time may increase the efficiency of manufacturing process and decrease the cost of the table 10.

Additional details regarding the size, shape and configuration of depressions that may be suitable for use in connection with the table top 12 are disclosed in Assignee's U.S. Pat. No. 7,069,865 and Assignee's U.S. Pat. No. 7,171,910, which are incorporated by reference in their entireties. One of ordinary skill in the art will appreciate that the depressions 22 may have a variety of suitable sizes, shapes and configurations depending, for example, upon the intended use of the table 10. It will also be appreciated that the table top 12 may include other features and structures, such as reinforcement portions, but the depressions and other features are not required.

As shown in FIGS. 1 and 2, the table top 12 may consist of a single, unitary, one-piece structure. The table top 12, however, could be constructed from any suitable number of sections to form, for example, a fold-in-half table. Advantageously, this may allow the table top 12 to be moved between a folded position and an unfolded position, which may facilitate transportation and storage of the table 10. Of course, the table top 12 may be constructed with any suitable number of components or sections depending, for example, upon the intended use of the table 10.

The table 10 may also include a frame 24 which is connected to the table top 12. The frame 24 may be sized and configured to increase the strength and/or rigidity of the table top 12. The frame may also allow, for example, the leg assembles 14, 16 to be attached to the table 10. In greater detail, as shown in FIGS. 1-2, the frame 24 may include one or more side rails, such as a first side rail 26 and a second side rail 28. The first and second side rails 26, 28 are preferably disposed proximate the outer edges of the table top 12 and the side rails may extend along all or a portion of the length of the table top. In particular, the side rails 26, 28 preferably extend along at least half of the length of the table top 12; however, the side rails could be longer or shorter.

Figure 10:
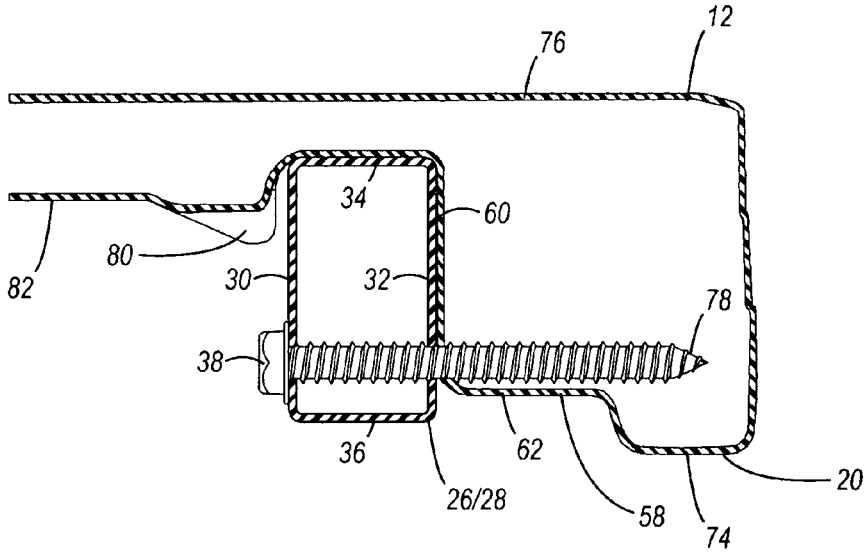
FIG. 10 is a cross-sectional side view of a portion of the table top and frame shown in FIG. 8.
Figure 11:
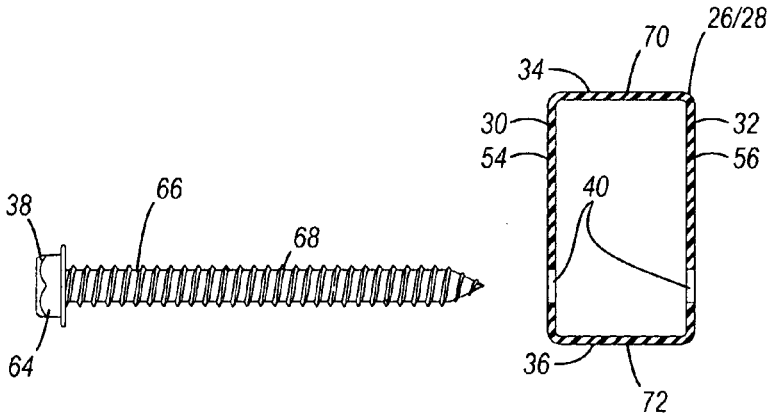
FIG. 11 is a cross-sectional side view of a portion of the frame and fastener shown in FIG. 8.
Figure 12:
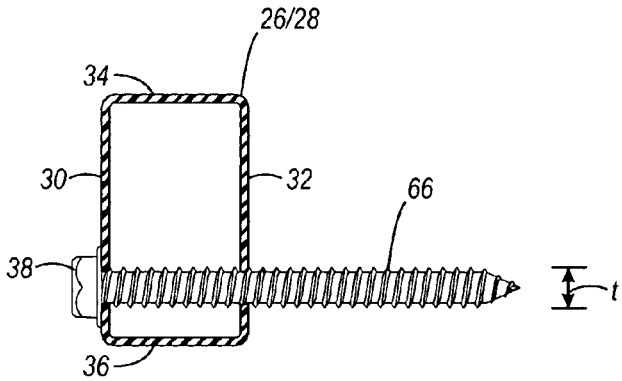
FIG. 12 is another cross-sectional side view of a portion of the frame and fastener shown in FIG. 8.

As shown in the accompanying figures, the side rails 26, 28 may comprise tubes, which may have a generally rectangular configuration. For example, as best seen in FIGS. 10-12, the side rails 26, 28 may include a first pair of spaced apart walls 30, 32 and a second pair of spaced apart walls 34, 36, which may be arranged in a generally rectangular cross-sectional configuration. It will be appreciated, however, that the side rails 26, 28 could have a cross-sectional configuration that is generally S-shaped, U-shaped, circular, polygonal, oblong, square, rectangular, square, planar, tubular, and/or other suitable shapes; and the side rails could be connected to any desired portions of the table top 12. It will also be appreciated that the frame 24 could have other suitable components, configurations and the like.

The frame 24 may be connected to the table top 12 using one or more suitable fasteners 38, such as rivets, bolts or screws and the like. For example, the side rails 24, 26 may include one or more openings 40 through which the fasteners 38 may extend to connect the side rails to the table top 12. The side rails 24, 26 may be also attached to the table top 12 using a snap fit, an interference fit, a friction fit and the like. It will be appreciated that the frame 24 and side rails 26, 28 may have a variety of suitable sizes, shapes and configurations.

The table 10 may also include one or more cross bars 42, which may be disposed proximate the ends of the table top 12. For example, the table 10 may include a first cross bar 42 that is disposed proximate one end of the table top 12 and a second cross bar that is disposed proximate the other end of the table top. The cross bars 42 may be attached to the side rails 26, 28 of the frame 24 and the cross bars may rotate relative to the table top 12. In particular, the ends of the cross bars 42 may be inserted into openings 44 in the side rails 26, 28 of the frame 24 and this may allow the cross bars to rotate relative to the table top 12. The leg assemblies 14, 16 may be attached to the cross bars 42 and/or the cross bars may form a portion of the leg assemblies. Advantageously, the cross bars 42 may help facilitate movement of the leg assemblies 14, 16 between the extended and collapsed positions. It will be appreciated that the cross bars 42 may be connected to any suitable portion of the table 10 and the cross bars do not have to rotate relative to the table top 12. It will also be appreciated that the table 10 could have any suitable number, configuration and/or arrangement of cross bars 42.

In addition, the table 10 may include one or more cross bars disposed proximate the center portion of the table top 12. For example, the table 10 may include a center cross bar 46 that is attached to the side rails 26, 28 of the frame 24 and the center cross bar may rotate or be held in a generally fixed position relative to the table top 12. In particular, the ends of the cross bar 46 may be inserted into openings 48 in the side rails 26, 28 of the frame 24 and this may allow the cross bar to rotate relative to the table top 12. The cross bar 46, however, may be connected to any suitable portion of the table 10 and the cross bar could have any suitable number, configuration and/or arrangement. It will also be appreciated that the cross bar 46 is not required.

The cross bars 42 and/or cross bar 46 could also have a configuration such as shown in Assignee's U.S. Pat. No. 6,915,748, which is incorporated by reference in its entirety. Of course, the cross bars 42 and/or the cross bar 46 could have other appropriate sizes, designs and the like depending, for example, upon the intended use of the table 10.

As shown in FIG. 1, the leg assemblies 14, 16 may be attached to the cross bars 42 and the cross bars may allow the leg assemblies to be moved between the extended and collapsed positions. For example, the leg assembly 14 may be rigidly connected to the first cross bar 42 and the first cross bar may be pivotally connected to the frame 24 to allow the leg assembly to be moved between the extended and collapsed positions. Similarly, the leg assembly 16 may be rigidly connected to the second cross bar 42 and the second cross bar may be pivotally connected to the frame 24 to allow the leg assembly to be moved between the extended and collapsed positions. The leg assemblies 14, 16 could also be pivotally attached to the cross bars 42 and the cross bars could be rigidly attached to the frame 24. It will be appreciated that the leg assemblies 14, 16 and/or the legs 18 do not require pivotal engagement with frame 24 or the table top 12, and the leg assemblies and/or legs may be connected to the table 10 in any suitable manner such as disclosed in Assignee's U.S. Pat. No. 7,100,518, which is incorporated by reference in its entirety.

The table 10 may also include braces 50, 52 that may be sized and configured to, for example, secure the leg assemblies 14, 16 in the extended position. For example, a first brace 50 may be connected to the first leg assembly 14 and the cross bar 46, and a second brace 52 may be connected to the second leg assembly 16 and the same cross bar. It will be appreciated that the braces 50, 52 may be connected to different cross bars 46 and/or different portions of the frame 24 or table top 12 depending, for example, upon the intended design or use of the table 10.

As mentioned above, the frame 24 may be connected to the table top 12 and FIGS. 2-3, 8 and 10 illustrate an exemplary connection of the frame to the table top. In particular, as shown in FIGS. 5-7 and 11, the side rails 26, 28 may include openings 40, such as slots, which may allow fasteners 38 to connect the side rails to the table top 12.

Figure 5:
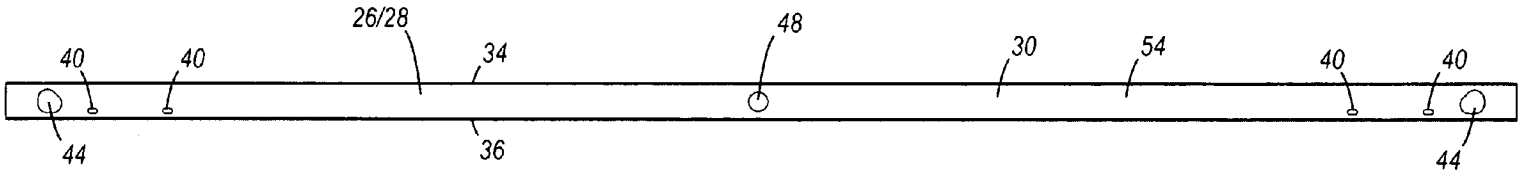
FIG. 5 is a side view of a portion of the frame shown in FIG. 2.
Figure 6:
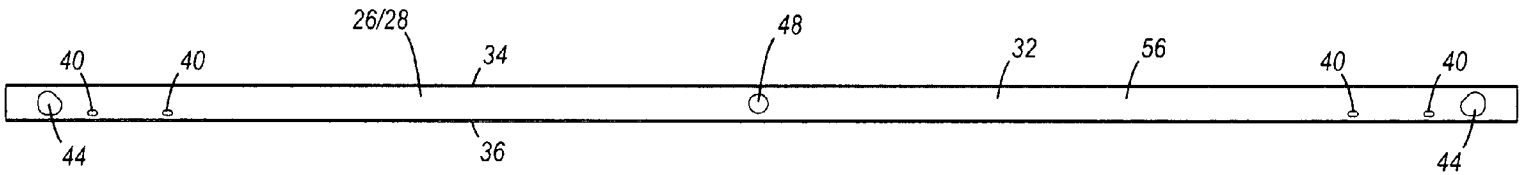
FIG. 6 is another side view of the portion of the frame shown in FIG. 5.
Figure 7:
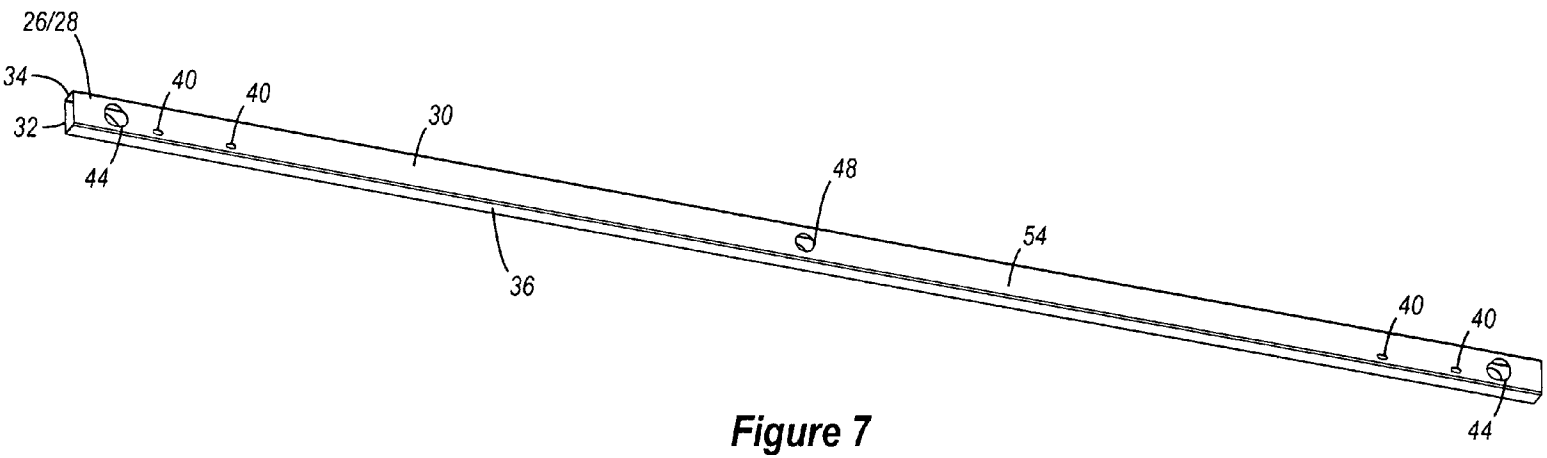
FIG. 7 is a perspective view of the portion of the frame shown in FIG. 5.

As shown in FIGS. 5-7, the side rails 26, 28 preferably include one or more openings 40 disposed near a first end of the side rail and one or more openings disposed near a second end of the side rail. As shown in FIGS. 5-7 and 11, the opposing walls 30, 32 and/or opposing sides 54, 56 of the side rails 26, 28 may include a pair of aligned openings 40 through which a fastener may be inserted. Consequently, the side rails 26, 28 may include, for example, two or more pairs of aligned openings 40 disposed near a first end of the side rail and two or more pairs of aligned openings 40 near a second end of the side rail. Advantageously, these aligned openings 40 may help position the fastener 38 in a generally level orientation relative to the table top 12. It will be appreciated, however, that the side rails 26, 28 may include any number of openings 40 in any suitable location and that the fastener 38 may be disposed in other orientations. It will also be appreciated that the openings 40 need not be slots, need not be aligned and may have other suitable configurations.

Figure 8:
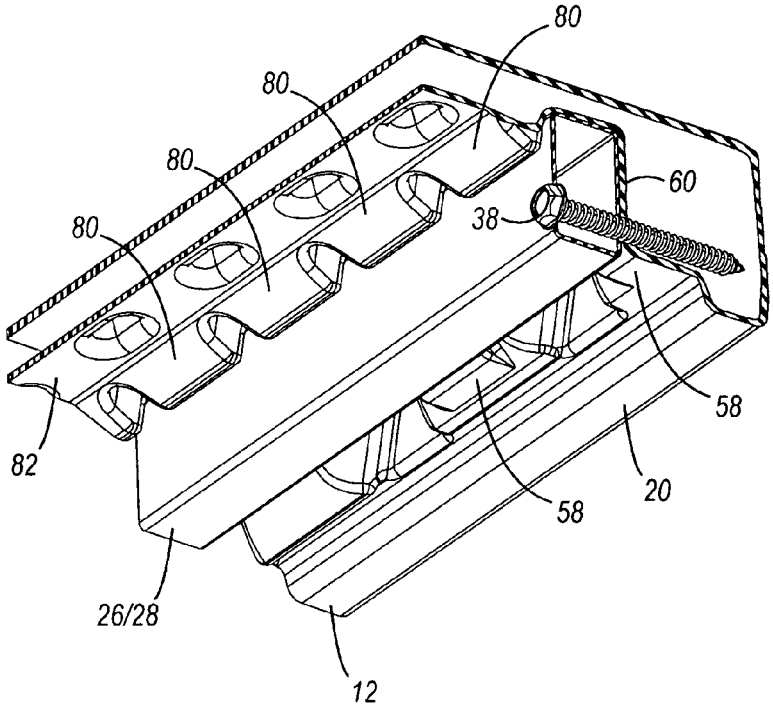
FIG. 8 is a cross-sectional view of a portion of the table top and frame shown in FIG. 2, illustrating an exemplary fastener connecting the frame and table top.
Figure 9:
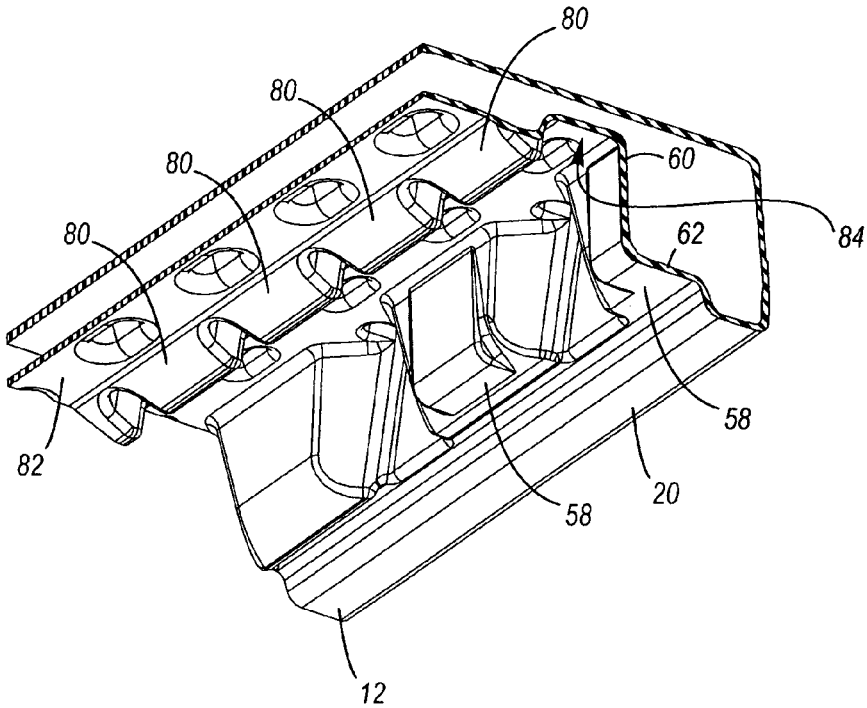
FIG. 9 is a cross-sectional view of a portion of the table top shown in FIG. 8 without the frame and the fastener.

As shown in FIGS. 8-10, the table top 12 may include one or more projections 58 extending from the lip 20. The projections 58 may include a wall 60 that may abut, contact, engage and/or support a portion of a side rail 26, 28. In particular, an outer surface of the wall 60 of the projection 58 may abut, contact, engage and/or support the wall 32 or surface 56 of the side rail 26, 28, which may advantageously help the table top 12 and the side rail to remain in a generally fixed relative position. If desired, a part of the wall 60 may be disposed below the fastener 38 and/or in generally perpendicular orientation relative to the fastener so that, when forces draw a side rail 26, 28 away from the table top 12, the part of the wall below the fastener may help resist the side rail's movement away from the table top. Resisting this movement may advantageously help the table top 12 and the side rail 26, 28 to remain in a generally fixed relative position. The wall 60 may advantageously have an increased thickness to increase its strength and help further resist such movement.

The projection 58 may also include a stop 62 that is sized and configured to abut, contact, engage and/or support the fastener 38. The stop 62 preferably forms at least a part of a lower portion of the projection 58; however, the stop may be spaced apart from a lower portion of the projection and may be formed in any other suitable portion of the projection and/or the table top 12. If desired, the stop 62 may be formed separately from the table top 12 and/or the projection 58, and the stop and may be connected to the table top and/or the projection using one or more fasteners, adhesives, and/or other suitable means.

As shown in FIG. 10, the stop 62 may have a generally planar configuration. For example, the stop 62 may comprise a wall that may include generally flat upper and lower surfaces that are generally parallel to each other. In particular, the wall's upper and lower surfaces may be spaced apart at a generally constant distance. It will be appreciated, however, the stop 62 may have other suitable shapes and/or configurations.

As shown in FIG. 10, the stop 62 may be disposed proximate to the fastener 38. Consequently, when forces draw the side rail 26, 28 away from the table top 12, a lower portion of the fastener 38 may quickly contact and/or engage the stop 62, which may help resist the side rail's movement away from the table top. For example, the lower portion of the fastener 38 may contact and/or engage a support or engaging surface of the stop 62, such as an upper surface of the stop, which may help support the fastener and the side rail and may help resist the side rail's movement away from the table top 12. Resisting such movement may advantageously help the table top 12 and the side rail 26, 28 to remain in a generally fixed relative position.

In further detail, as shown in FIGS. 11-12, the fastener 38 may include an enlarged head 64 and an elongated body 66, which may include one or more threads 68. Desirably, the elongated body 66 may be positioned within a first distance from the stop 62, and the first distance may advantageously be less than the thickness t of the elongated body. If desired, the elongated body 66 may be positioned within 10 millimeters, 9 millimeters, 8 millimeters, 7 millimeters, 6 millimeters, 5 millimeters, 4 millimeters, 3 millimeters and/or 2 millimeters from the stop 62. The elongated body 66 may be positioned at smaller distances from the stop 62 and may even contact the stop depending, for example, upon the particular configuration of the stop 62. It will be appreciated that the elongated body 66 may be positioned at greater distances from the stop 62, if desired.

To help position the fastener 38 and the stop 62 proximate each other, the fastener and/or the openings 40 may be disposed proximate the lower wall 36 of the side rail 26, 28 and/or may be offset from the middle of the side rail. In further detail, the openings 40 are preferably positioned at a first distance from a lower surface 72 of the side rail 26, 28 and a second distance from an upper surface 70 of the side rail, which may be at least two times, at least three times, and/or at least four times the first distance. Also, the openings 40 are preferably positioned at a first distance from the lower wall 36 and a second distance from the upper wall 34, which may be at least two times, at least three times, and/or at least four times the first distance. It will be appreciated, however, that the fastener 38 and/or the openings 40 may be positioned in any other suitable location and need not be offset from the middle of the side rail 26, 28.

In addition, to help position the fastener 38 and the stop 62 proximate each other, the stop 62 may be offset from and/or positioned above a lower wall 74 of the lip 20, the lower wall 36 of the side rail 26, 28, and/or the lower surface 72 of the side rail. Consequently, the stop 62 may be positioned between an upper wall 76 of the table top 12 and the lower wall 74, the lower wall 36 and/or the lower surface 72. It will be appreciated, however, that the stop 62 may be positioned in other suitable locations.

As shown in FIGS. 8 and 10, the fastener 38 may abut the stop 62, and the stop may be generally disposed below the elongated body 66 of the fastener. The fastener 38 preferably extends along at least half of the depth of stop 62 and may extend past the stop. Consequently, when forces draw the side rail 26, 28 away from the table top 12, the fastener 38 may contact and/or engage the stop 62. In particular, when such forces draw the side rail 26, 28 away from the table top 12, the fastener 38 preferably contacts and/or engages the stop 62 along at least half of the stop's depth. With the fastener 38 contacting the stop 62 in this fashion, these forces may be applied to a larger part of the stop. This may advantageously help prevent the fastener 38 from tearing through the projection 58 and/or the stop 62. The fastener 38 and the stop 62 may also be positioned in generally parallel planes, which may help further spread out such forces to help prevent such tearing. Desirably, the generally aligned openings 40 formed in the walls 30, 32 of the side rail 26, 28 may help resist torque applied to the fastener 38 to help retain the fastener and the stop in generally parallel planes to help prevent such tearing. In addition, the fastener 38 may include a tapered and/or pointed end portion 78, and all or at least a portion of the tapered and/or pointed end portion may extend past the stop 62, which may even further help prevent such tearing.

As shown in FIGS. 2-4 and 8-10, the table top 12 may include one or more projections 80 extending from a lower surface 82 of the table top. In addition, the table top 12 may include one or more recessed portions 84, such as channels or grooves. Desirably, the projections 58, the projections 80 and/or the recessed portions 84 may abut, contact and/or engage a side rail to help the table top 12 and the side rail to remain in a generally fixed relative position. For example, at least a portion of the side rails 26, 28 may be disposed within the recessed portions 84 and/or sandwiched between the projections 58, 80, which may help to secure the table top 12 and the side rail in a generally fixed relative position. Preferably, this may help secure the table top 12 and the side rail in a generally fixed relative position in which the fastener 38 and the stop 62 are proximate each other and/or are in generally parallel planes.

Preliminary testing that used various aspects of embodiments disclosed herein indicated that approximately 140 pounds of force could be applied to the table 10 before the table would be damaged. The preliminary testing also indicated that over 300 pounds of force could be applied before the fasteners 38 would be removed. The preliminary testing further indicated that over 300 pounds of force could be applied before the frame 24 would be detached from the table top 12.

The components of the table 10 may be constructed of a variety of materials. For example, the table top 12, the lip 20, the depressions 22, the projections 58, 80, the stops 62 and/or the recessed portions 84 are preferably constructed from materials such as plastic. The leg assemblies 14, 16, the legs 18, frame 24, the side rails 26, 28, the fasteners 38, the cross bars 42, 46 and braces 50, 52 are preferably constructed from a relatively strong materials such as metal. It will be appreciated, however, that these and other components of the table 10 may be constructed from other materials with other suitable characteristics.

In further detail, the leg assemblies 14, 16, the legs 18, frame 24, the side rails 26, 28, the cross bars 42, 46 and braces 50, 52 are preferably constructed from metal, such as steel. In particular, all or a portion of these components may be constructed from steel tubes and these components may be finished, for example by painting or powder coating, to protect the components from the elements. Advantageously, the steel tubes may help create a table 10 that is strong and able to support a relatively large amount of weight. The steel tubes may have, for example, a cross-sectional configuration that is generally circular, polygonal, oblong, square, rectangular, square, or the like. These components, however, may have other suitable sizes, shapes and configurations, depending, for example, upon the intended purpose or use of the table.

The components of the table 10 may also be integrally formed as part of unitary, one-piece structures during a molding process or other suitable manufacturing process. For example, the table top 12, the lip 20, the depressions 22, the projections 58, 80, the stops 62 and/or the recessed portions 84 may be integrally formed as part of a unitary, one-piece structure during a blow molding process. In addition, the table top 12, the lip 20 and/or the projections 58, 80 may include hollow interior portions, which may be in communication with each other and which may be integrally formed as part of the unitary, one-piece structure during the blow molding process.

Integrally forming these items as part of unitary, one-piece structure may advantageously help reduce manufacturing time and, thus, the costs associated with that manufacturing time. It will be appreciated that the table top 12, the lip 20, the depressions 22, the projections 58, 80, the stops 62 and/or the recessed portions 84 need not be integrally formed as part of any unitary, one-piece structure and may include a plurality of separately formed components formed via a variety of manufacturing processes.

Other suitable features of tables are described in U.S. Pat. No. 6,655,301; U.S. Pat. No. 6,550,404; U.S. Pat. No. 6,530,331; U.S. Pat. No. 6,848,370; and U.S. patent application Ser. No. 11/112,236, filed Apr. 22, 2005, now abandoned, which are incorporated by reference in there entireties.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A portion of a table comprising:

a frame;

a table top constructed from blow-molded plastic, the table top including an upper surface, a lower surface and a hollow interior portion that are integrally formed as part of a unitary, one-piece structure during a blow-molding process;

a lip downwardly extending from the lower surface of the table top, the lip including a lower surface, an inner surface and a hollow interior portion that are integrally formed with the table top as part of the unitary, one-piece structure;

a projection extending inwardly from the inner surface of the lip, the projection comprising:

a wall with an engagement surface that abuts a portion of the frame; and a stop that is disposed generally perpendicular to the wall, the stop having a length measured from the wall to the lip; and a fastener connecting the frame to the projection, the fastener including an elongated body with a first portion disposed within the frame and a second portion disposed proximate the stop, the second portion of the elongated body being disposed generally parallel to at least one-half the length of the stop, the second portion of the elongated body being spaced apart from an inner surface of the stop by a distance generally equal to or less than a thickness of the elongated body.

2. The portion of a table as in claim 1, wherein the second portion of the elongated body of the fastener abuts the inner surface of the stop.

3. The portion of a table as in claim 1, wherein a lower portion of the fastener engages the inner surface of the stop to resist movement of the frame relative to the table top.

4. The portion of a table as in claim 1, wherein the elongated body of the fastener extends beyond the stop and into the hollow interior portion of the lip.

5. The portion of a table as in claim 1, wherein the frame includes two spaced apart walls and an opening is disposed in a lower portion of each of the walls proximate a lower portion of the frame; and wherein the fastener is inserted into the opening in the lower portion of each of the walls and the first portion of the fastener is disposed proximate the lower portion of the frame.

6. The portion of a table as in claim 5, wherein the lower surface of the lip is disposed in a first plane, the lower portion of the frame is disposed in a second plane, and the outer surface of the stop is disposed in a third plane;

wherein the second plane is disposed between the first plane and the second plane; and wherein the first plane, the second plane and the third plane are disposed in generally parallel planes.

7. The portion of a table as in claim 5, wherein the lower surface of the lip is disposed in a first plane, the lower portion of the frame is disposed in a second plane, and the inner surface of the stop is disposed in a third plane;

wherein the second plane is disposed between the first plane and the second plane; and wherein the first plane, the second plane and the third plane are disposed in generally parallel planes.

8. The portion of a table as in claim 1, wherein the second portion of the elongated body of the fastener is sized and configured to contact and abut an inner surface of the stop to help securely connect the frame to the table top when a force is applied to the table top.

9. The portion of a top as in claim 1, wherein the frame has a width generally equal to the length of the stop.

10. The portion of a table as in claim 1, wherein the fastener has a length that is greater than a width of the frame and the length of the stop.

11. An apparatus comprising:

a table top including an upper surface, a lower surface and a downwardly extending lip;

a projection on an inner surface of the lip, the projection comprising:

an engagement surface; and a stop including a length measured from the engagement surface to the lip;

a frame member including an engagement surface that engages the engagement surface of the projection; and a fastener connecting the frame member to the projection, the fastener including a first portion disposed within the frame member and a second portion disposed generally parallel to and extending along at least one-half the length of the stop, the second portion of the fastener being spaced apart from the stop by a distance less than a thickness of a body of the fastener.

12. The apparatus as in claim 11, wherein the second portion of the fastener is disposed generally parallel to an inner surface of the stop; and wherein the fastener has a length greater than a width of the frame member and the length of the stop.

13. The apparatus as in claim 11, wherein an end of the fastener is disposed within a hollow interior portion of the lip.

14. The apparatus as in claim 11, wherein the length of the stop is generally equal to or greater than a width of the frame member.

15. The apparatus as in claim 11, wherein the second portion of the fastener is sized and configured to contact and abut an inner surface of the stop to resist movement of the fastener and frame member relative to the table top.

16. The apparatus as in claim 11, wherein the fastener has an elongated body with a diameter, the second portion of the fastener being spaced apart from an inner surface of the stop by a distance generally less than or equal to the diameter of the fastener.

17. The apparatus as in claim 11, wherein the fastener has an elongated body with a diameter;

wherein the first portion of the fastener is spaced apart from a lower portion of the frame member by a distance generally less than or equal to the diameter of the fastener; and wherein the second portion of the fastener is spaced apart from an inner surface of the stop by a distance generally less than the diameter of the fastener.

18. The apparatus as in claim 11, wherein a lower surface of the lip is disposed in a first plane, a lower portion of the frame member is disposed in a second plane, and an outer surface of the stop is disposed in a third plane;

wherein the second plane is disposed between the first plane and the second plane; and wherein the first plane, the second plane and the third plane are disposed in generally parallel planes.

19. The apparatus as in claim 11, wherein a lower surface of the lip is disposed in a first plane, a lower portion of the frame member is disposed in a second plane, and an inner surface of the stop is disposed in a third plane;

wherein the second plane is disposed between the first plane and the second plane; and wherein the first plane, the second plane and the third plane are disposed in generally parallel planes.

20. The apparatus as in claim 11, wherein the second portion of the fastener abuts an inner surface of the stop.

* * * * *

UNITED STATES PATENT AND TRADEMARK OFFICE

CERTIFICATE OF CORRECTION

PATENT NO. : 7,905,185 B2
APPLICATION NO. : 11/703880
DATED : March 15, 2011
INVENTOR(S) : Peery et al.

It is certified that error appears in the above-identified patent and that said Letters Patent is hereby corrected as shown below:

IN THE SPECIFICATIONS:

In Column 3, Line 65, delete “flow-molded” and insert -- blow-molded --, therefor.

Signed and Sealed this
Twenty-fourth Day of April, 2012

David J. Kappos

David J. Kappos
*Director of the United States Patent and Trademark Office*